United States Patent [19]

Mizukawa et al.

[11] Patent Number: 4,555,608

[45] Date of Patent: Nov. 26, 1985

[54] INVERTER DEVICE FOR INDUCTION HEATING

[75] Inventors: Takumi Mizukawa, Neyagawa; Yoshio Ogino, Takatsuki; Hideki Ohmori, Kawanishi; Taketoshi Sato, Toyonaka, all of Japan

[73] Assignee: Matsushita Electric Industrial Co., Ltd., Kadoma, Japan

[21] Appl. No.: 522,373

[22] PCT Filed: Nov. 2, 1982

[86] PCT No.: PCT/JP82/00426

§ 371 Date: Jul. 5, 1983

§ 102(e) Date: Jul. 5, 1983

[87] PCT Pub. No.: WO83/01721

PCT Pub. Date: May 11, 1983

[30] Foreign Application Priority Data

Nov. 4, 1981 [JP] Japan ..... 56-176871

[51] Int. Cl.[4] ..... H05B 6/06; H05B 6/64

[52] U.S. Cl. ..... 219/10.77; 219/10.49 R

[58] Field of Search ..... 219/10.77, 10.49 R, 219/10.79; 363/97

[56] References Cited

U.S. PATENT DOCUMENTS 3,898,410 8/1975 Peters, Jr. ..... 219/10.49 R 4,115,677 9/1978 Yamamura et al. ..... 219/10.49 R

FOREIGN PATENT DOCUMENTS 52-96316 8/1977 Japan .

*Primary Examiner*—Roy N. Envall, Jr.

*Assistant Examiner*—Marvin M. Lateef

*Attorney, Agent, or Firm*—Wenderoth, Lind & Ponack

[57] ABSTRACT

An induction heating device makes use of a bridge inverter and has a DC power source, a plurality of switching elements forming a bridge inverter, and a circuit for detecting the turn-off of the switching elements. In order to detect the turn-off of the switching elements, an improved turn-off detection circuit is employed and an improved control circuit is installed to prevent the circuit from malfunctioning owing to external noise.

2 Claims, 3 Drawing Figures

INVERTER DEVICE FOR INDUCTION HEATING

BACKGROUND OF THE INVENTION

1. Field of the Invention

This invention relates to a bridge inverter for use in induction heating apparatuses having large load variations, particularly induction heating cooking appliances.

2. Description of the Prior Art

Generally, in an inverter device for induction heating cooking appliances, since the load is in the form of a pan, stabilized operation is required irrespective of the material of the pan and irrespective of the presence or absence of a pan. Further, as is known in the art, a bridge inverter comprises a plurality of series-connected switching elements connected to a power source, the output from said converter being obtained at the junction of the series connection, said switching elements being alternately or successively driven. This inverter, however, has drawbacks; for example, when the switching time of the elements is prolonged by a temperature increase or when there is a large variation in the load, there is the danger of the switching elements being simultaneously rendered conductive and thereby damaged. As a solution to this problem, the common means is to provide a fixed dwell period for stopping all the switching elements at the drive signal switching time in consideration of the amount of variation when the switching time varies. This means, however, does not essentially eliminate the danger of simultaneous conduction, and the provision of a sufficient dwell period has been the major cause of reduction of the operating efficiency of the inverter device. On the other hand, when an erroneous input signal is transferred to the control circuit, this is very undesirable since it leads to the simultaneous conduction of the switching elements of the inverter device or to abnormal oscillation thereof if the signal is on the level of not damaging the elements. As a solution of this problem, the common means is to stabilize the circuit by using a capacitor or the like which bypasses erroneous input signals. This means, however, depends on the correlation between the capacitance of the capacitor and the magnitude of the erroneous input signal, and can hardly serve as a radical solution to the problem.

SUMMARY OF INVENTION

The present invention provides an inverter device which operates in an efficient and stable manner, rarely malfunctioning, despite variations in load and in the parameters of the switching elements of the inverter device. Thus, it provides a bridge inverter device which functions on the principle of detecting the complete turn-off of one of two switching elements by detecting rising and falling voltage signals and then driving the other of the two switching element. Concerning erroneous input signals, during driving of either switching element, any input signal from the inverter is inhibited to ensure that there is essentially no simultaneous conduction taking place even if there is a variation in the characteristics of the switching elements or an initial variation. Furthermore, the inverter device is highly stable against malfunction and abnormal oscillation.

DESCRIPTION OF THE PREFERRED EMBODIMENT

Figure 1:
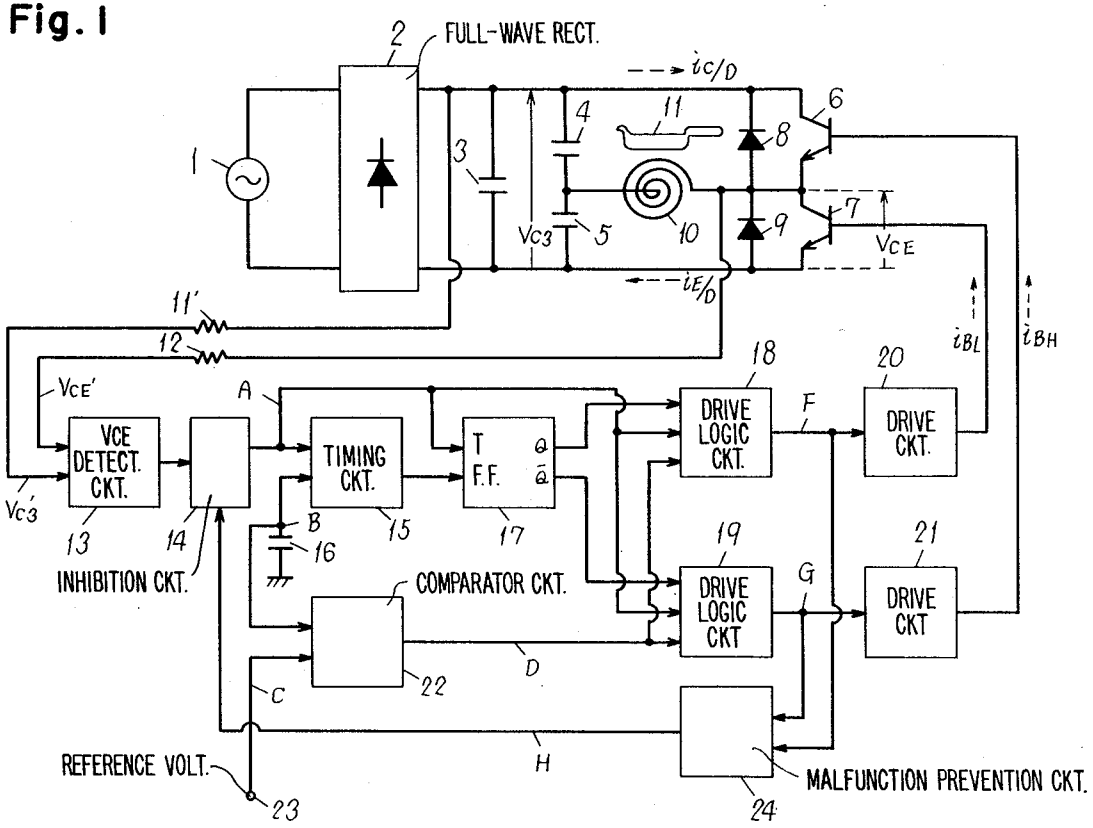
FIG. 1 is a block diagram showing an inverter device for induction heating according to an embodiment of the invention.

The arrangement will be described with reference to FIG. 1. The numeral 1 denotes a commercial AC voltage source; numeral 2 denotes a full-wave rectifier; numeral 3 denotes a filter capacitor, these parts constituting a rectifier circuit. The numerals 4 and 5 denote resonance capacitors, and 6 and numerals 7 denote switching elements, which are transistors in this embodiment and will be hereinafter referred to as transistors. The numerals 8 and 9 denote diodes connected across said transistors 6 and 7, respectively. The numeral 10 denotes an induction heating and 11 denotes a cooking pan, these parts constituting a bridge inverter circuit. The numeral 11' and 12 denote resistors connected to the capacitor 3 and the collector of the transistor 7, respectively, dividing the respective voltages. The numeral 13 denotes a $V_{CE}$ detection circuit wherein the capacitor 3 and the collector voltage of the transistor 7 are connected to the input terminal through the resistors 11' and 12 so as to generate pulses at the output terminal in response to the rising and falling of the collector voltage of the transistor 7. The numeral 14 denotes an inhibition circuit using the output terminal of the $V_{CE}$ detection circuit 13 as its input, its output terminal determining whether or not to pass the output from the $V_{CE}$ detection circuit 13 on the basis of the signal level at a control input terminal H. The numeral 15 denotes a timing circuit and a backup oscillator (hereinafter referred to as timing circuit) using the output A of the inhibition circuit 14 as its trigger input, with a timing capacitor 16 being connected to the timing input terminal, the output being connected to one of the trigger terminals of a T flip-flop 17, said timing capacitor 16 being adapted so as to be discharge and reset by means of the output A of the inhibition circuit 14. On the other hand, the backup oscillator is provided for forcibly changing the driving order if the detection voltage adjacent the zero phase of the commercial power source should be too low to actuate the $V_{CE}$ detection circuit 13, the arrangement being such that it is prevented from operating during the time that the timing capacitor 16 is reset by the output from the inhibition circuit 14. The timing capacitor 16 is connected to said timing circuit 15 and to a comparator circuit 22. The T flip-flop 17 has two trigger inputs to which the output A of the inhibition circuit 14 and the output of the timing circuit 15 are connected, the arrangement being such that the timing circuit 15 normally produces no output and the T flip-flop 17 will be triggered and its state reversed by the output A of the inhibition circuit 14, the outputs Q and $\overline{Q}$ being connected to drive logic circuits 18 and 19, respectively. The drive logic circuits 18 and 19 each have three inputs, and are arranged such that the output A of the inhibition circuit 14, outputs Q and $\overline{Q}$ of the T flip-flop 17 and the output D of the comparator 21 are connected to the input terminals, and the drive logic circuit which is selected by the T flip-flop operates for a period of time determined by the output D of the comparator 21 and the output A of the inhibition circuit 14. The numeral 20 and 21 denote drive circuits adapted to receive output signals from the drive logic circuits 18 and 19 to amplify them and to impart drive signals to the bases of the transistors 6 and 7. The comparator circuit 22 makes an external comparison between the voltage of the timing capacitor 16 and a reference voltage (at a terminal 23), so as to thereby determine the period of operation of the drive logic circuits 18 and 19. The the reference voltage terminal 23 of the comparator circuit 22 is fed with an external voltage, said terminal acting to inhibit the drive logic circuits 18 or 19 when the voltage of the timing capacitor 16 is lower than the reference voltage. The numeral 24 denotes a malfunction preventing logic circuit, having the outputs F and G of the drive logic circuits 18 and 19 connected to the inputs thereof and having its output H connected to the inhibition circuit 14, it being noted that any output signal from the inhibition circuit 14 is inhibited when the output F or G is producing a signal.

In the above arrangement, the operation will now be described with reference to FIGS. 1 and 2. In FIG. 2, $V_{CE}'$ and $V_{C3}'$ are signal input waveforms provided by dividing the collector voltage $V_{CE}$ of the transistor 7 and the voltage $V_{C3}$ of the capacitor 3. The waveform iE/D is the waveform of current flowing through the parallel circuit of the transistor 7 and diode 9. The waveform iC/D is the waveform of current flowing through the parallel circuit of the transistor 6 and diode 8. The waveform $i_{BL}$ is the waveform of the base drive current through the transistor 7 and the waveform $i_{BH}$ is the waveform of the base drive current through the transistor 6. In FIG. 2, the forward bias current is indicated by waveform $I_{B1}$ and the reverse bias current is indicated by waveform $I_{B2}$. The waveforms A-H are output voltage waveforms appearing at the various points in FIG. 1.

Figure 2:
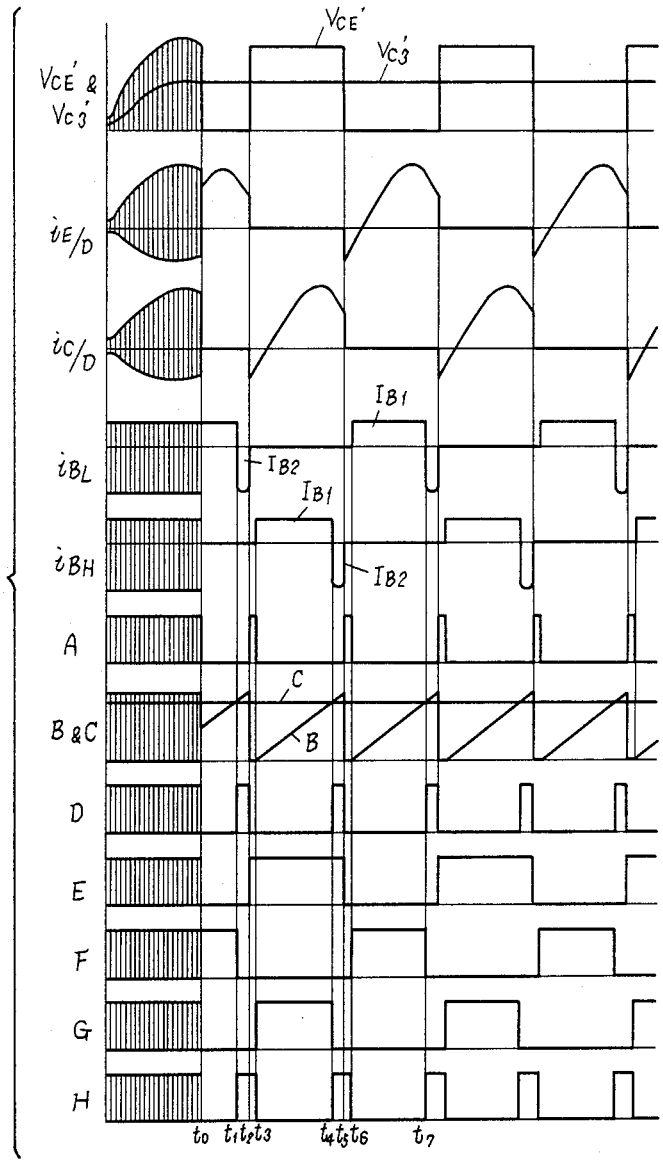
FIG. 2 is a waveform diagram showing the operation of FIGS. 1 and 3.

FIG. 2 shows the bridge inverter of FIG. 1 oscillating and also shows waveforms with the axis of the time enlarged from time $t_0$. For the purpose of explanation of the operation, the operation at time $t_1$ onward will be described. At time $t_1$, the base drive signal F for the transistor 7 disappears and the base drive circuit 20 outputs a reverse bias voltage which has changed from the forward bias voltage to the base terminal of the transistor 7. When the reverse bias voltage is fed to the base of the transistor 7, the base current of the transistor 7 shown by $i_{B2}$ of waveform $I_{BL}$ in FIG. 2 flows and when the collected carriers are discharged, the transistor 7 is turned off. When the transistor 7 is turned off, the collector voltage rises. That is, at time $t_2$, when the collector detection voltage $V_{CE}'$ of the transistor 7 crosses the detection voltage $V_{C3}'$ of the capacitor 3, a pulse output is produced at the output of the $V_{CE}$ detection circuit 13. Thus, the turn-off detection of the transistor 7 is effected by comparing the detection voltage $V_{C3}$, of the capacitor 3 with the collector voltage which rises sharply due to the induction heating coil 10 when the transistor 7 is turned off and, then, detecting the point at which the two voltages are equal. Using the detection voltage $V_{C3}$, of the capacitor 3 as the reference voltage in the turn-off detection means that when the inverter is not driven by a perfect direct current source but rather by a voltage which is nearly pulsating, the collector detection voltage $V_{C3}$, surely becomes equal to the detection voltage $V_{C3}$, at at least one point in time. When, as noted above, an output is produced by the $V_{C3}$ detection circuit 13, the output H of the malfunction preventing logic circuit 24 keeps the inhibition circuit 14 open at an H (logic high) level (the operation at this point will be later described), and the output pulse from the $V_{CE}$ detection circuit is fed to the timing circuit 15 and the T flip-flop circuit 17 through the inhibition circuit 14 (time $t_2$, A waveform). As soon as the timing capacitor 16 is discharged, the state of the T flip-flop 17 is reversed, whereby the previously selected drive logic circuit 18 is replaced by the drive logic circuit 19. On the other hand, since the timing capacitor 16 discharges, the comparator circuit 22 has its output D reversed so as to become an L (logic low) level, thus opening the drive logic circuits 18 and 19. At this time $t_2$, although the drive logic circuit 19 has been selected, it has the output A of the inhibition circuit 14 transferred thereto, so that the drive logic circuit 19 is inhibited for the duration corresponding to the pulse width of this output A. When said output A terminates (at time $t_3$), the output G becomes an H level and the base current $i_{BH}$ which drives the drive circuit 21 and transistor 6 begins to flow. The point at which the base current $i_{BH}$ begins to flow is set during the time a current is flowing through the diode 6 of the inverter, said current through the diode 6 having a waveform shown by waveform iC/D in FIG. 2 because of the free oscillation of the resonance capacitors 4 and 5 and induction heating coil 10. At time $t_3$, since a signal at an H level is generated at the output G of the drive logic circuit 19, the output H of the malfunction preventing logic circuit 24 becomes the L level, putting the inhibition circuit 14 in the inhibition state to prevent it from accepting output signals from the $V_{CE}$ detection circuit 13. In addition, the base current to be produced next is delayed for the time ($t_2$-$t_3$) during which the inhibition circuit 14 is producing the output A; this duration is provided in order to wait for the time when the rising of the collector voltage is completed by the turn-off of the transistor 6 or 7, and this duration is not necessary if the switching elements are capable of ideal switching action. When the discharge of the timing capacitor 16 is terminated at time $t_3$ by the output A of the inhibition circuit 14, the timing capacitor 16 begins to charge (B waveform in FIG. 2). When the voltage (B waveform) of the timing capacitor 16 reaches the voltage (C waveform) at the reference terminal 23 of the comparator circuit 22 (at time $t_4$), the output D of the comparator circuit 22 changes from an L level to an H level, putting the drive logic circuit 19 in the inhibition state, with the output G becoming an L level, thus stopping the drive circuit 21 and imparting a reverse bias voltage to the base of the transistor 6, whereupon the base current waveform $i_{BH}$ begins to have $I_{B2}$ discharge the collected carriers. On the other hand, at this time $t_4$, since the output G of aforesaid drive logic circuit 19 disappears, the output H of the malfunction preventing logic circuit 24 is brought to an H level, putting the inhibition circuit 14 in the open state to enable it to accept output pulses from the $V_{CE}$ detection circuit 13. Upon termination of said reverse base bias current $I_{B2}$ of the transistor 6, the latter turns off (time $t_5$) and, though not shown in FIG. 2, the collector-emitter voltage of the transistor 6 rises. When the collector-emitter voltaage of the transistor 6 rises, since the transistors 6 and 7 are connected in series with the DC power source, the collector-emitter voltage ($V_{CE}'$ in FIG. 2) of the transistor 7 drops. If this drop results in the input voltage of the $V_{CE}$ detection circuit 13 crossing the division voltage $V_{C3}'$ of the capacitor 3, a pulse output is produced at the output of the $V_{CE}$ detection circuit, while a pulse voltage is produced at the output A of the inhibition circuit 14. Upon production of the output A of the inhibition circuit 14, the timing capacitor 16 is discharged and at the same time the state of the T flip-flop 17 is reversed (E waveform, time $t_5$) and the drive logic circuit 18 is selected. Upon termination of the output A of the inhibition circuit 14 (time $t_6$), the output F of the drive logic circuit 18 becomes an H level, actuating the drive circuit 20 to turn off the transistor 7, with the output F bringing the output H of the malfunction preventing logic circuit 24 to a L level and putting the inhibition circuit 14 in the inhibition state. When the charging (B waveform) of the timing capacitor 16 reaches the reference voltage (C waveform) of the comparator circuit 22 (time $t_7$), the base drive current of the transistor 7 terminates, and the same operation is repeated henceforth.

Figure 3:
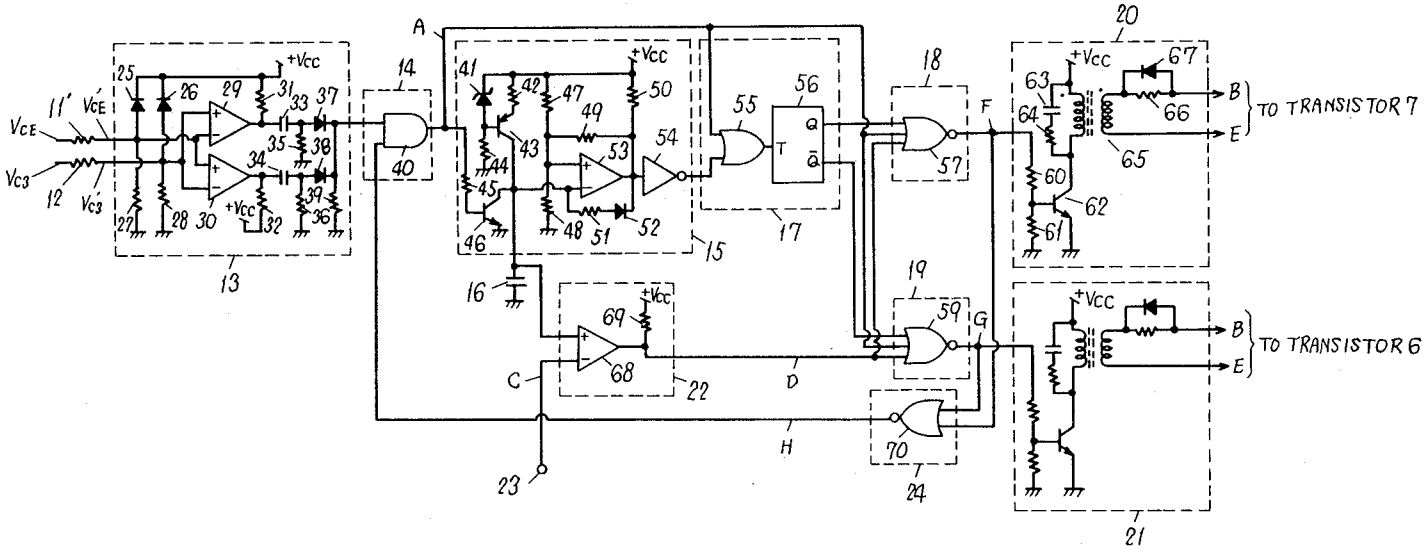
FIG. 3 is an electric circuit diagram showing a concrete electric circuit for the device.

The arrangement of FIG. 3 will now be described. FIG. 3 is an electrical wiring diagram forming a concrete embodiment of FIG. 1 of the invention. In FIG. 3, the numerals 25, 26, 37, 39, 52, and 67 denote diodes, numerals and 27, 28, 31, 32, 35, 36, 39, 42, 44, 45, 47–51, 60, 61, 64, 66 and 69 denote resistors. The numerals 33, 34, and 63 denote capacitors; numerals 29, 30, 53, and 68 denote voltage comparators; and numeral 41 denotes a zener diode. The numeral 40 denotes an AND circuit; numeral 54 denotes a NOT circuit; numeral 55 denotes an OR circuit; numeral 56 denotes a T flip-flop; numerals 57, 59 and 70 denote 3-input and 2-input NOR circuits. The numerals 43, 46 and 62 denote transistors, and numeral 65 denotes a pulse transformer. In addition, in FIG. 3, the blocks and voltage output signals (A-H) having the same functions as in FIG. 1 are marked with like numerals. A description of the drive circuit 21 is omitted since it is the same as the drive circuit 20.

In the above arrangement, the operations of the blocks will now be described in brief.

In the $V_{CE}$ detection circuit 13, when $V_{CE}'$ and $V_{C3}'$ cross each other, a rising signal is produced at the output of one of the two voltage comparators 29 and 30 and a falling signal at the output of the other of the two compacitors. These rising and falling signals are differentiated by the resistors 31 and 32 and capacitors 33 and 34. The differentiated signals are such that only the pulses of positive direction are produced across the resistor 39 by the diodes 37 and 38. The inhibition circuit 14 is an AND circuit whose operation is well-known, and a description thereof is omitted. The timing circuit 16 comprises a constant current charging circuit including the zener diode 41, resistors 42 and 44 and transistor 43, a discharging circuit for the timing capacitor 16 including the resistor 45 and transistor 46, and an oscillation circuit including the resistors 47–51, diode 52 and voltage comparator 53. The timing capacitor 16 begins to charge owing to the constant current charging circuit, and when the inhibition circuit 14 produces an output pulse, the transistor 46 is turned on and the timing capacitor 16 quickly discharges. The timing with which the inhibition circuit 14 produces output pulses is shorter than the oscillation period of the oscillation circuit; normally, the oscillation circuit does not operate and the output of the voltage comparator circuit 53 is at an H level, while the output of the NOT circuit 54 remains at an L level. The T flip-flop circuit 17 comprises a T flip-flop having two trigger inputs and is so arranged that when a rising input signal is imparted to either input, the outputs Q and $\overline{Q}$ are reversed. The drive logic circuits 18 and 19 and the NOR circuit of the malfunction preventing logic circuit 24 are well-known, and a description thereof is omitted. The drive circuits 20 and 21 form a base driving circuit using a pulse transformer. For example, in the drive circuit 20, when the transistor 62 is turned on, a forward base bias current flows through the transistor 7 of the inverter, and when it is turned off, the reverse electromotive force of the pulse transformer 65 applies a reverse base bias voltage. The comparator circuit 22 comprises the voltage comparator 68 and its output will be at an L level if the voltage of the timing capacitor 16 is lower than the voltage at the terminal 23.

According to the present invention, the rising or falling of the collector voltage of a transistor of a bridge inverter is detected and then the next transistor is driven. Thus, even when the collection time of the transistor is prolonged owing to a rise in the temperature of the element or is caused to vary owing to initial variations, the transistor discharges the collected carrier to turn off and the rise of the collector voltage (if the transistor on the opposite side is turned off, the falling of the collector voltage of the detection transistor) is detected. As a result, the simultaneous conduction of the series-connected transistors can be prevented. Furthermore, since the switching time of the drive timing can be reduced to the extent allowed by the maximum capacity of the transistor, the resulting inverter device is high in operating efficiency. In addition, the invention has used a transistor type inverter for switching elements, but the same operation can be attained by using gate turn-off thyristors capable of being turning off at their gate terminals. Furthermore, according to the present invention, it is possible to provide a highly stable device which will not accept erroneous trigger signals from the outside in that when a drive signal is produced at a transistor of the inverter, the turn-off detection pulse input of the transistor is inhibited.

We claim:

1. An inverter device for induction heating, comprising a bridge inverter having a pair of series-connected switching elements connected to a DC power source and having an output obtained from a junction between said switching elements, a circuit for detecting the turn-off of said switching elements comprising a voltage comparator having one input terminal connected to said junction and another input terminal connected to said DC power source wherein said turn-off is detected when the voltages at said one and another input terminals become equal, and a timing circuit and a flip-flop circuit which are connected to an output of said turn-off detection circuit, the arrangement being such that after the turn-off of one of said switching elements has been detected, the other switching element is driven.

2. An inverter device for induction heating as set forth in claim 1, wherein said output of said turn-off detection circuit is connected to said timing circuit and flip-flop circuit through an inhibition circuit, an inhibition input terminal of said inhibition circuit being fed with a signal used for driving said pair of switching elements, the arrangement being such that while one of said switching elements is being driven, the generation of signals by said turn-off detection circuit is inhibited.

* * * * *